US009920599B2

(12) United States Patent
Hashem

(10) Patent No.: US 9,920,599 B2
(45) Date of Patent: Mar. 20, 2018

(54) REMEDIATION OF OIL SPILLS UNDER SEA ICE

(71) Applicant: Mohamed Hashem, Houston, TX (US)

(72) Inventor: Mohamed Hashem, Houston, TX (US)

( * ) Notice: Subject to any disclaimer, the term of this patent is extended or adjusted under 35 U.S.C. 154(b) by 0 days.

(21) Appl. No.: 15/227,247

(22) Filed: Aug. 3, 2016

(65) Prior Publication Data

US 2018/0038205 A1 Feb. 8, 2018

(51) Int. Cl.

| | |
|---|---|
| ***E21B 43/30*** | (2006.01) |
| ***E21B 43/01*** | (2006.01) |
| ***E21B 43/17*** | (2006.01) |

(52) U.S. Cl.
CPC ..... *E21B 43/0122* (2013.01); *E21B 43/17* (2013.01)

(58) Field of Classification Search
CPC ..... E21B 7/008; E21B 43/30
See application file for complete search history.

(56) References Cited

U.S. PATENT DOCUMENTS

| | | | | |
|---|---|---|---|---|
| 3,111,986 A * | 11/1963 | Kuhn, Jr. | ..... | E21B 43/243 166/245 |
| 3,749,162 A * | 7/1973 | Anders | ..... | E21B 7/008 114/264 |
| 2003/0173081 A1* | 9/2003 | Vinegar | ..... | E21B 43/243 166/272.1 |

* cited by examiner

*Primary Examiner* — Catherine Loikith
(74) *Attorney, Agent, or Firm* — Matthew J Patterson

(57) ABSTRACT

A safe and effective method for remediation and removal of trapped oil, since oil spills trapped under ice present a significant environmental problem. Injector wells are placed around a periphery of trapped oil to inject fluids beneath the ice. A producer well is placed within the periphery and the hydrostatic pressure from the injector wells urges the oil toward and up through the producer well.

7 Claims, 1 Drawing Sheet

REMEDIATION OF OIL SPILLS UNDER SEA ICE

BACKGROUND OF THE INVENTION

Field of the Invention

Embodiments of the invention generally relate to techniques for remediating and removing oil spills or oil pockets trapped under ice.

Description of the Related Art

Conventional oil spills are dealt with by many known methods including containment, evaporation, burning and mechanical skimming. None of these prior art techniques are very effective in arctic or icy conditions. Fixed ice typically extends over a vast are in arctic regions and it caps or traps oil spills. In addition none of the prior art methods deals in any way with the dangers that are exist with respect to $H_2S$ that accompanies the oil.

It is known that oil is trapped under ice under various circumstances including spills, leaks and blowouts. There are also known techniques for locating and quantifying these spills trapped under the ice. In many circumstances the spills may occur in relatively shallow depths. As the ice thickness it grows toward and approaches the seabed and the area that the trapped oil occupies increases accordingly. The ice also impedes direct access to the trapped oil and prevents vertical percolation by acting like a seal cap.

Various methods have been attempted to remediate oil trapped under sea ice with limited success. These methods include dispersants, direct pumping and skimming.

Therefore, there exists a need for techniques to effectively remediate and remove oil trapped under sea ice, including mechanical methods.

SUMMARY OF THE INVENTION

The invention generally relates to methods for containing and removing oil trapped under sea ice using multiple wells. For certain aspects, a plurality of injector wells and producer wells are employed. Injector wells are positioned around the periphery of the spill and at least one producer well is positioned inside the periphery. The injector wells preferably inject any fluid including water, a solvent or any other fluid or chemical, to more effectively allow the oil be displaced and collected at the producer well. The invention also may include a pump connected to the producer well to facilitate extraction of the oil. In addition, the invention may include sand control and collection apparatus and methods.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
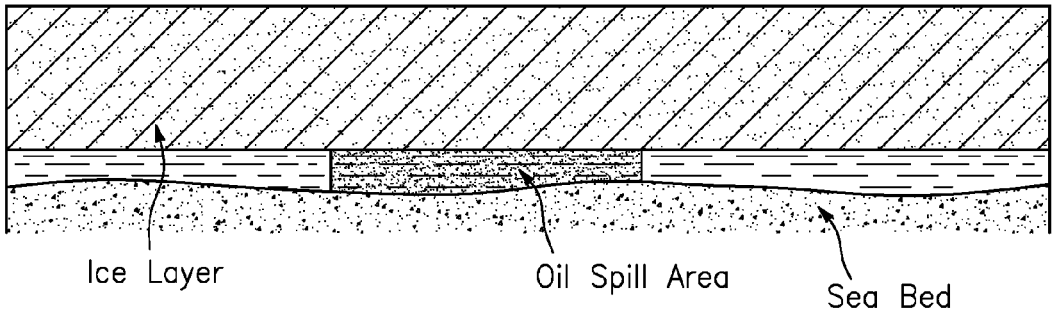
FIG. 1 illustrates a situation typical of oil trapped under sea ice.

Once trapped oil is located beneath sea ice as shown in FIG. 1 by any known method, the present invention provides an efficient and effective technique for remediation and removal of the oil. In addition, the present invention provides for the only known method of removing oil trapped under sea ice that safely controls and eliminates the hazards of $H_2S$ exposure.

Figure 2:
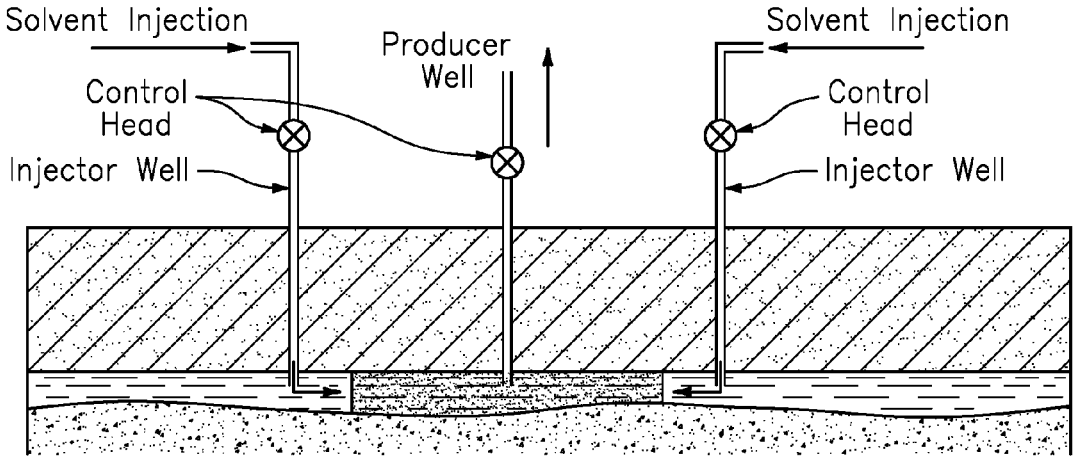
FIG. 2 illustrates an example of injector wells and a producer well configured to remediate and remove the trapped oil of FIG. 1, in accordance with certain aspects of the present disclosure.
Figure 3:
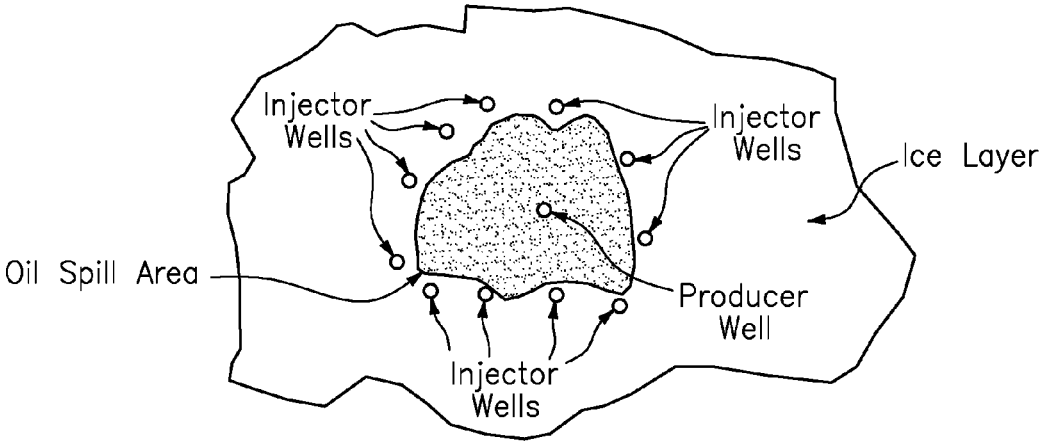
FIG. 3 illustrates an example of injector wells and a producer well in plan view configured to remediate and remove the trapped oil of FIG. 1, in accordance with certain aspect of the present disclosure.

For certain applications, and as best shown in FIGS. 2 and 3, a plurality of relatively small holes are drilled completely through the ice around the periphery of the spill. The holes are preferably drilled using pipe that will remain in place after drilling and provide the conduit for injection of water and/or solvent as will be more fully described herein after. After drilling, a gap may exist between the pipe and the drilled hole. The gap may be sealed by pouring water around the outer diameter of the pipe and allowing the water to freeze, thereby sealing the pipe within the sea ice. The number and position of the plurality of pipes need for injector wells is dictated by the size, shape and position of the oil trapped under the sea ice.

The present invention includes the placement of at least one producer well within the periphery of the injector wells. The producer well is installed similar to the injector wells as described herein above with a few exceptions. The producer well is installed by employing pipe to drill a relatively small hole into the ice and initially stopping a few feet above the bottom of the sea ice. The thickness of the ice may be determined by any known method including the monitoring of the thickness while installing the injector well pipes. A control head, or valve, as is known in the art is positioned on the producer pipe and then the producer ell pipe is driven down below the thickness of the pipe and into the trapped oil reserve. Any gap that may exists between the hole and the producer pipe may be sealed by pouring water around the outer diameter of the pipe and allowing the water to freeze, thereby sealing the pipe within the sea ice.

The present invention may also include any known pumping device attached to the producer well to facilitate extraction and removal of the trapped oil.

The present invention may further also include any known sand control and collection device. This aspect of the invention is advantageous in conditions where the bottom of the ice may be close or in contact with the seabed especially if the seabed is not itself frozen. With the control and collection of sand contaminated with oil the present invention allows for the remediation of the sand and the environmental risks posed thereby.

As is shown in FIG. 2 control heads are installed on the injector wells and the producer well. The control heads on the injector wells are set up for injection of water and/or solvent, or any other chemicals or fluids, and the control head on the producer well is set up for production of oil from the trapped reserve using well known methods.

The above-described approaches involve designing a system within the limitations and constraints of the injector wells and producer well.

Example Remediation of Oil Spills Under Sea Ice

Once the injector wells and producer well are installed and positioned as described herein above the extraction of the trapped oil may begin. The method of remediating and removing oil trapped under sea ice of the present invention is initiated by the injection of water and/or solvent, or other suitable fluids, through the injector wells positioned around the periphery of the trapped oil. The injection of the fluids through the injector wells and into the sea water produces hydrostatic forces that displace and urge the trapped oil to migrate towards and up through the producer well. Oil that is produced through the producer well is captured in tanks or containers or is otherwise removed from the area by any known method.

It should be appreciated by those skilled in the art that the present invention provides for the safe and controlled removal of $H_2S$ contained with the trapped oil. The present method allows for the $H_2S$ to be removed from under sea ice and placed into sealed containers. This method prevents the known hazards posed to humans by exposure to even small amounts of $H_2S$ and its vapors.

It should be appreciated by those skilled in the art that if the trapped oil area is very large, the method described herein above may have to be repeated to completely remediate and remove the trapped oil. To repeat the process the invention contemplates repeating the pattern of placing injectors around a predetermined periphery inside of the entire area of trapped oil. Once the smaller area of trapped oil is removed another pattern of injector wells in position around a predetermined periphery wherein some of the previous producer wells are employed as injector wells. The process is repeated in an inwardly progressive pattern until the entire area of trapped oil is removed.

Advantages

The present invention as described herein above has many advantages over the prior art. The method of remediating and removing oil trapped under sea ice includes the ability to effectively deal with sour gasses, such as $H_2S$, as is commonly found in crude oil reserves. In embodiments of the invention that employ solvent as the injection fluid there is the added advantage the solvent also works to clean away oil residue. As described herein above the oil that is collected in to tanks can be further treated and reclaimed for resale. In employing the techniques of the present invention any cracks or gaps that may be created can be effectively sealed simply adding water and allowing it to freeze in-situ. Yet another advantage of the present invention is that it provides a fast and efficient process because the volume of the trapped oil is constantly controlled within the periphery of injector wells.

While the foregoing is directed to embodiments of the present invention, other and further embodiments of the invention may be devised without departing from the basic scope thereof, and the scope thereof is determined by the claims that follow.

What is claimed is:

1. A method of remediating oil trapped below a layer of ice comprising:

locating the oil trapped directly below the ice and positioned within sea water between a bottom surface of the ice and a top surface of a sea bed;

determining a perimeter of the oil in contact with the bottom surface of the ice;

drilling an injector well through the ice proximate the perimeter of the oil;

drilling a producer well into the ice within the perimeter of the oil;

installing a production pipe into the producer well and into the oil;

sealing the production pipe within the layer of ice;

injecting a fluid into the injector well and into the sea water;

using the fluid to urge the oil along the bottom surface of the ice and towards the producer well; and removing the oil from the producer well.

2. The method of claim 1 wherein the fluid comprises a solvent.

3. The method of claim 1 wherein the injecting and removing comprises using at least one pump.

4. The method of claim 1 further comprising controlling the injecting and removing using at least one control head.

5. The method of claim 1 further comprising installing pipe in the injector and producer wells.

6. The method of claim 1 wherein oil includes a sour gas and wherein the removing further comprises removing the sour gas.

7. The method of claim 6 wherein the sour gas comprises $H_2S$.

* * * * *